US006340862B1

(12) United States Patent
Lecheler et al.

(10) Patent No.: US 6,340,862 B1
(45) Date of Patent: Jan. 22, 2002

(54) FLUORESCENT LAMP WITH LUMINESCENT MATERIAL LAYER THICKNESS ACCORDING TO THE GEOMETRICAL DISCHARGE DISTRIBUTION

(75) Inventors: Reinhard Lecheler, Neuburg an der Donau; Hermann Schweizer, Neusaess; Michael Seibold, Munich, all of (DE)

(73) Assignee: Patent-Treuhend-Gesellschaft fuer Elektrische Glüehlampen mbH, Munich (DE)

( * ) Notice: Subject to any disclaimer, the term of this patent is extended or adjusted under 35 U.S.C. 154(b) by 0 days.

(21) Appl. No.: 09/446,013

(22) PCT Filed: Apr. 9, 1999

(86) PCT No.: PCT/DE99/01094

§ 371 Date: Dec. 16, 1999

§ 102(e) Date: Dec. 16, 1999

(87) PCT Pub. No.: WO99/54915

PCT Pub. Date: Oct. 28, 1999

(30) Foreign Application Priority Data

Apr. 20, 1998 (DE) ..... 198 17 477

(51) Int. Cl.[7] ..... H01J 1/62; H01J 63/04

(52) U.S. Cl. ..... 313/484; 313/485; 313/491; 313/634

(58) Field of Search ..... 313/484, 485, 313/488, 491, 607, 634, 635, 632, 594, 631, 234, 496, 495, 110; 315/246, 250, 260

(56) References Cited

U.S. PATENT DOCUMENTS

| | | | | |
|---|---|---|---|---|
| 5,365,354 A | * | 11/1994 | Jannson et al. | 359/15 |
| 5,604,410 A | * | 2/1997 | Vollkommer et al. | 313/607 |
| 5,903,095 A | * | 5/1999 | Yoshida et al. | 313/485 |
| 5,994,849 A | * | 11/1999 | Vollkommer et al. | 313/607 |
| 6,034,470 A | * | 3/2000 | Vollkommer et al. | 313/485 |
| 6,060,828 A | * | 5/2000 | Vollkommer et al. | 313/607 |

FOREIGN PATENT DOCUMENTS

| | | |
|---|---|---|
| DE | 19526211 | 1/1997 |
| DE | 19636965 | 3/1998 |
| WO | 9423442 | 10/1994 |

* cited by examiner

*Primary Examiner*—Nimeshkumar D. Patel
*Assistant Examiner*—Mariceli Santiago
(74) *Attorney, Agent, or Firm*—Robert F. Clark

(57) ABSTRACT

A fluorescent lamp, in particular for the backlighting of liquid crystal display screens, having a discharge vessel with a gas filling, the discharge vessel having a fluorescent layer and an electrode structure for a dielectric impeded discharge, the electrode structure fixing a geometric distribution of partial discharges and the fluorescent layer having a thickness variation in accordance to the geometrical distribution of the partial discharges.

20 Claims, 5 Drawing Sheets

FLUORESCENT LAMP WITH LUMINESCENT MATERIAL LAYER THICKNESS ACCORDING TO THE GEOMETRICAL DISCHARGE DISTRIBUTION

BACKGROUND OF THE INVENTION

The present invention relates to a fluorescent lamp for dielectrically impeded discharges. Such a fluorescent lamp has a discharge vessel with a gas filling, and a fluorescent layer. An electrode structure is designed for a dielectrically impeded discharge, that is to say at least a portion of the electrodes is separated from the gas filling by a dielectric. The details of the design of the lamp are gone into here only to the extent required to understand the invention.

Otherwise, reference is made to the following published prior art, the disclosure content of which is incorporated herewith:

DE 196 36 965.7=WO 97/01989 DE 195 26 211.5=WO 97/04625 and DE-Patent 43 11 197.1=WO 94/23 442.

In this case, the first of the cited applications exhibits an electrode structure which is configured specially by means of nose-like extensions of the cathodes and fixes a geometric distribution of partial discharges during operation of the lamp.

SUMMARY OF THE INVENTION

This invention is based on the technical problem of developing a fluorescent lamp of the type mentioned at the beginning such that the light-emitting properties are optimized.

According to the invention, this problem is solved by means of a fluorescent lamp having a discharge vessel filled with a gas filling and with a fluorescent layer, and having an electrode structure for a dielectrically impeded discharge, in which fluorescent lamp the electrode structure fixes a geometric distribution of partial discharges during operation of the lamp, wherein the fluorescent lamp has a varying layer thickness tuned to the geometric distribution.

The invention proceeds from the consideration that the uniformity of the luminance of a light exit surface is essential for important possibilities of applying fluorescent lamps with dielectrically impeded discharges. This relates, in particular, to the design, denoted as a flat radiator, of those fluorescent lamps having the discharge vessel constructed essentially from two parallel plates and a frame therebetween. Such flat radiators can be used, in particular, for the backlighting of display devices, chiefly liquid crystal display screens. In order to avoid disturbing the legibility and the appearance of the display, luminance fluctuations of, for example, 15% are already critical in this case. However, the uniformity of the luminance can also play a role in other technical fields, and this invention is not limited to the field of flat radiators or the backlightings of display devices.

Separating luminance variations in the case of which compensation by means of the measures of this invention is useful from luminance variations which can be tolerated depends largely on the requirements of the respective field of use. In particular, in the case of application to the backlighting of liquid crystal display screens, luminance reductions in the regions between partial discharges should be compensated in any case by more than 20% with respect to the maxima, preferably starting as early as limits of 15%, 10% or 5%.

If said range of luminance reduction of more than 20% with respect to the maxima is defined as the intermediate discharge range, according to a refinement in accordance with the invention reductions in the layer thickness of the fluorescent layer to 30%–95%, preferably 50%–90%, of the maximum layer thickness are provided immediately over the discharges for the intermediate discharge regions in a fashion averaged over their surface.

Since, in the case of the fluorescent lamps according to the invention it is advantageous in any case for temporal and spatial stability of the overall discharge structure to take measures which spatially fix the individual partial discharges of the overall discharge structure, the basic idea of the invention consists in utilizing this fixing of the partial discharges to the further effect of not, as is conventional, depositing the fluorescent layer of the fluorescent lamp flat and homogeneous, but of designing it with a layer thickness variation tuned to the specified geometric distribution of the partial discharges.

For example, the partial discharges fixed by means of the abovementioned nose-like cathode projections, which partial discharges are of essentially triangular formation in the case of the operation, given preferential consideration here, of active-power units launched pulsewise, stand with a vertex of the triangle on a respective cathode nose and can thereby be distributed in a predictable way. An quasi-complementary distribution of the fluorescent material can then lead to a compensation of the variations in the luminance, which would arise in the case of a homogeneous fluorescent layer thickness on the basis of the partial discharge distribution.

This possibility emerges from the fact that thinning of the fluorescent layer in a locally limited region leads in accordance with the findings of the inventor to a local increase in the luminance. This result is initially surprising, since a reduction in the generated quantity of visible light would be inferred as obvious from a reduction in the quantity of fluorescent material. However, the distribution of the visible light in the discharge vessel is so diffuse and undirected overall that a local thinning of the fluorescent layer initially has no perceptible effects on the visible light intensity present, but rather permits a larger portion of the visible light to exit from the fluorescent lamp owing to the locally reduced absorption and reflection in the fluorescent layer.

It is entirely possible in this case, and also intended in conjunction with the employed terms of layer thickness variation or reduction in the layer thickness, to form local cutouts in the fluorescent layer, that is to say to reduce the layer thickness to zero.

It is to be stated, furthermore, that the term partial discharges is not intended to be limited to partial discharges separated cleanly from one another. Rather, overall discharge structures can also be conceived in which partial discharges are rather local centroids of an overall discharge structure having a plurality of centroids.

Finally, the invention is not fixed on a specific form of an electrode structure fixing the arrangement of the partial discharges, in particular not fixed on the cathode projections already mentioned. In addition to these cathode projections, thickness variations of an electrode dielectric are also possible, for example. Thus, in bipolar operation of a dielectric discharge, all the electrodes are covered with a dielectric layer, because the anode and cathode roles of individual electrodes interchange alternately. In the case of unipolar operation, at least the anodes are covered with a dielectric layer. In order to reduce sputter damage on the cathodes, the latter are, however, frequently likewise covered with a—possibly thinner—dielectric layer. In each of the abovenamed cases, the thickness of the respective dielectric layers in their spatial surface distribution plays a role in the arrangement of the individual partial discharges. With a thinner layer thickness, the high-frequency resistance for the high-frequency Fourier components of individual active-power pulses drops, and thus the electric field effectively present in the gas filling rises. Consequently, the partial discharges tend to an arrangement of local thinned regions of dielectric layers on the electrodes.

Furthermore, the electrode width can also be varied. The partial discharges tend in this case to the arrangement of locally widened points of the electrodes. This is probably caused by the fact that a larger locally available electrode surface in turn causes a lower high-frequency resistance and a larger-area distribution of the shielding countercharges built up on the dielectric surface.

In the thickness variation of the fluorescent layer according to the invention, it can be preferred to generate an approximately continuous transition between regions of maximum and minimum layer thickness. For this purpose, it is possible to use a stepped variation in layer thickness in the transition region, for example. This has advantages, in particular, with regard to the production method, in which printing methods for depositing the fluorescent layer are generally used. In the case of the abovementioned stepped variant, it is possible here to make use of two or more partial layers with geometric structures deviating in detail from one another, with the result that the desired stepped variation in layer thickness is produced during the addition of the partial layers. Production by means of screen printing is preferred in this connection.

However, it is not necessary for overall fluorescent layers produced in a plurality of partial printing steps finally to be left in a stepped state. Rather, the production method can also be designed to the effect that the partial layers are deposited in a state of such low viscosity, or are brought during drying to such a state, that the originally present steps run together, resulting finally in a continuous transition.

For the purpose of effective compensation of the luminance which varies owing to the distribution of the discharge centroids, it is preferred to arrange the respectively thinnest regions of the fluorescent layer in the projection in the direction of the main light exit direction in the middle between the individual partial discharges, and the regions of greatest layer thickness directly above the respective partial discharges. In this case, the minimum and the maximum layer thicknesses and the regions corresponding to them can result in a suitable local averaging in the case of structures which are fine and no longer optically separable outside the lamp.

Arranging cutouts or thin regions in the fluorescent layer in an arrangement in the middle between the partial discharges is also advantageous from the point of view that the smallest loss in ultraviolet light occurs in this region due to an excessively thin fluorescent layer. Consequently, the overall light yield of the fluorescent lamp can remain virtually unchanged despite the homogenizing effect of the variation in layer thickness of the fluorescent layer.

As already mentioned, according to the invention cutouts in the fluorescent layer are also to be understood as variations in layer thickness. Particularly simple is the production of fluorescent layers in which, apart from cutouts, there is an essentially uniform layer thickness. Production then results from a single printing step with an appropriate structure, for example a printing screen. In many cases, it suffices to use such a quasi-discrete distribution of layer thickness. Reference is made to the exemplary embodiments for this purpose.

Finer transitions can be produced in this case such that a fine pattern of cutouts in the fluorescent layer lead to a quasi-continuous course between regions of (average) thin and (average) thick layer thicknesses by means of varying the surface proportions of the cutouts and the remaining fluorescent layer in a local averaging. The term "fine" is measured by the fact that fine structures of the fluorescent layer can no longer be resolved or separated optically in the appearance of the fluorescent lamp, for example after passage through an external diffuser or a milk-glass disk. Consequently, the structures must be fine by comparison with the spacing between neighboring partial discharges, because in the case of fluorescent lamps in which the invention can be used particularly usefully, it is precisely an optical separation of the neighboring partial discharges which is possible. For this purpose as well, exemplary embodiments will be further represented.

A further concrete representation of the geometry of the invention follows from the locally limited nature, already mentioned at the beginning, of the cutouts or regions of reduced fluorescent layer thickness. It is easy to see that such a disproportionately extended region leads to a reduction in the overall yield of the fluorescent lamp owing to the lack of fluorescent material to a greater extent. Moreover, excessively large regions can also appear darkened by comparison with the surrounding region. (with fluorescent material), because the launching of the diffuse light in the discharge vessel can no longer adequately brighten up the large region with an excessively small fluorescent layer thickness.

The intermediate plate spacing has proved to be a suitable reference variable at least in the case of the flat radiator fluorescent lamps described. It is preferred for the cutouts to be narrower than 100%, better 50% or 30%, of this spacing at least in one direction.

The homogenization of the luminance distribution of a fluorescent lamp intended by the invention can also be achieved in principle using known optical diffusers. Consideration is given, for example, to prismatic foils (in particular of the type of the brightness-enhancement foils from the manufacturers 3M) for varying not only the solid angle distribution of the light exit, but also for homogenizing the luminance, furthermore in the material of diffusely scattering foils and the like. The essential disadvantage consists, however, in that disproportionate use of such optical diffusers reduces the quantity of light coupled out for the same electric power. However, maximization of this quantity of light is above all the priority in the case of the backlighting applications already mentioned. This is a preferred field of use for the invention.

The compensating effect of an optical diffuser can also be enhanced by increasing spacing from the flat radiator fluorescent lamp. However, this increases the overall height, which is very limited in the case of many applications, in particular in the field of the backlighting of liquid crystal display screens.

The variations in layer thickness represented which serve to compensate a modulation in luminance owing to partial discharges in the fluorescent lamp can also be combined with appropriate measures around spacers and supporting elements which can be carried out in the same way as here. For this purpose, reference is made to the parallel application entitled "Leuchtstofflampe mit Abstandshaltern und lokal verdünnter Leuchtstoffschichtdicke" ["Fluorescent lamp having spacers and a locally thinned fluorescent layer thickness"] from the same applicant with the same date of application.

Furthermore, it has proved to be particularly favorable in this connection to make use as an optical diffuser of a milk-glass layer which is either constructed as overlay glass on the transparent glass wall bounding the discharge vessel, or is this glass wall itself.

Some concrete exemplary embodiments of the structures of fluorescent layers according to the invention are represented below. Individual features disclosed in this case can also be essential to the invention in other combinations. In detail:

Description of the Preferred Embodiments

Figure 1:
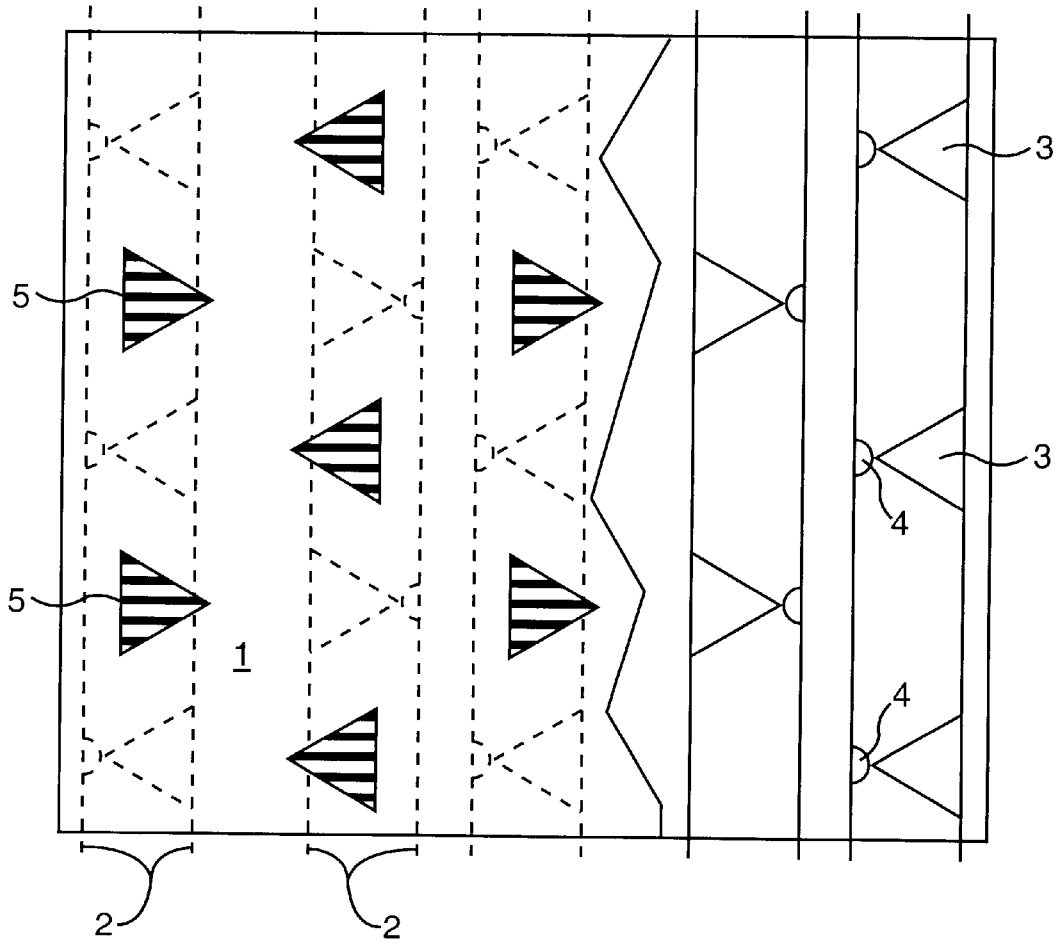
FIG. 1 shows a schematic partial view of an electrode structure of a fluorescent lamp according to the invention, burning partial discharges therebetween, and an adapted structured fluorescent layer, partially broken away.

FIG. 1 shows a schematic partial view with an electrode structure of a fluorescent lamp according to the invention, burning partial discharges therebetween and an adapted structured fluorescent layer; and each of FIGS. 2–5 shows a further example of an adaptively structured fluorescent layer, partial discharges also being drawn in part.

FIG. 1 shows a partial representation having a typical electrode structure 2 of a fluorescent lamp according to the invention, the remaining structural details of the lamp being left out for the sake of clarity. Reference is made for this purpose to the cited prior art.

The electrode structure 2 is arranged in a plane on a base plate of a flat radiator fluorescent lamp, semicircular projections 4 directed toward the respectively neighboring anode being constructed on the cathodes. A triangular partial discharge 3 burns respectively between each of these projections 4 and the most closely neighboring anode. The partial discharges 3 are thus distributed in an essentially flat fashion in the flat radiator discharge vessel.

Arranged over this flat arrangement of partial discharges 3 is a fluorescent layer 1 which corresponds essentially to the white plane of the paper. However, in this case the fluorescent layer 1 includes cutouts 5 which largely correspond in geometric shape to the partial discharges and are hatched to distinguish them from the partial discharges. These cutouts 5 are arranged between the neighboring partial discharges 3, specifically with the direction of the triangular shape reversed in each case. This results inside each pair of neighboring cathode and anode in an alternating sequence of partial discharges 3 and cutouts 5.

If the fluorescent layer 1 structured in this way is covered according to the invention with a milk-glass plate, or if it is deposited on the inside of a milk-glass plate, or if an external diffuser is used, the cutouts 5 oppose the regions of the fluorescent layer 1 which appear brighter owing to the partial discharges 3 situated immediately therebelow with a brightening of the intermediate region between the cutouts 5, which otherwise appears excessively dark. Owing to the compensating effect of the milk-glass disk, the overall result is the substantial reduction in the variation of luminance.

However, the simple structure represented here further offers possibilities for improvement, specifically, on the one hand, with regard to the abrupt transitions between the cutouts 5 and the otherwise closed fluorescent layer 1, as well as with reference to the strips, not yet covered by compensatory measures, between the respectively alternating rows of cutouts 5 and partial discharges 3.

Figure 2:
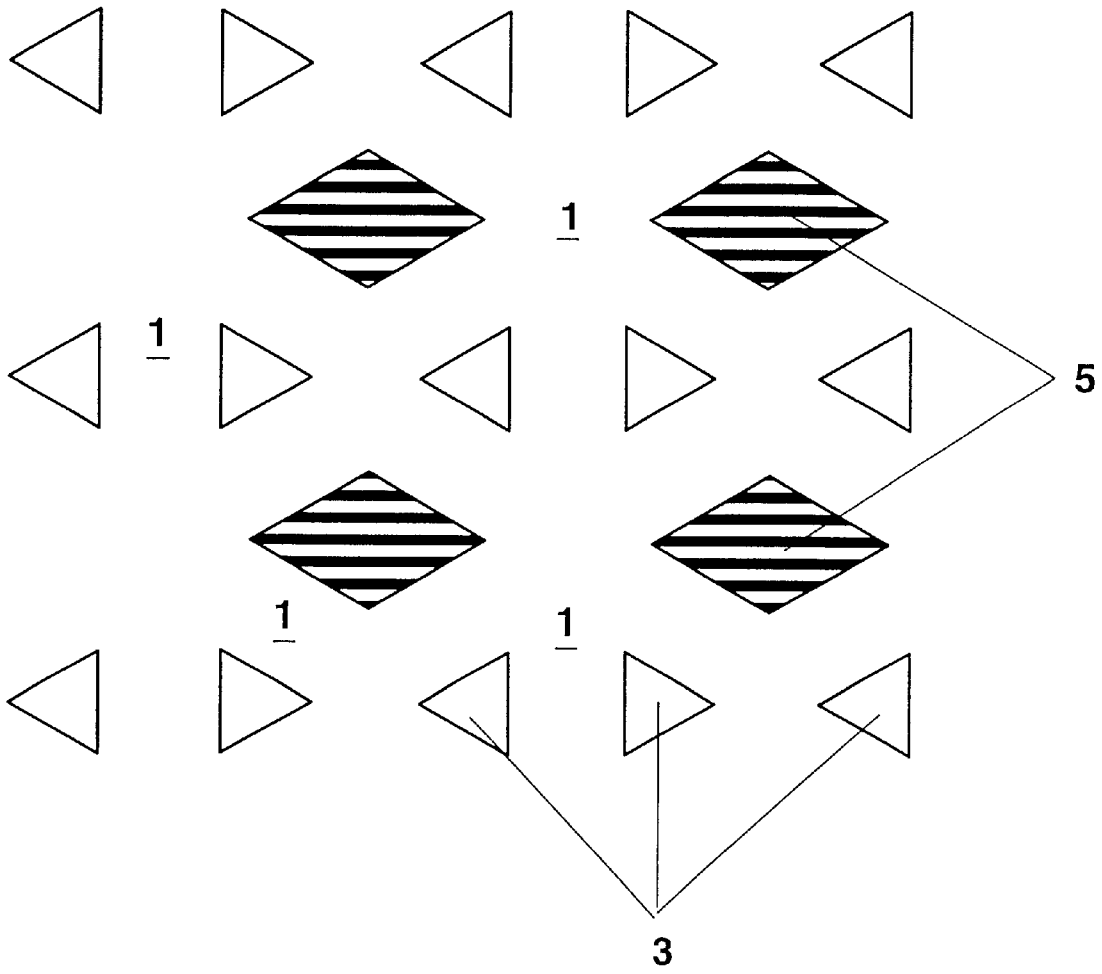
FIG. 2 shows a schematic view of an adapted fluorescent layer having lozenge-shaped cutouts in relation to the partial discharges.

Corresponding considerations hold for the structure represented in FIG. 2. There, the electrodes 2 are firstly not drawn, in order not to disturb the possibility of recognizing the geometric relationship between the cutouts 5 and the partial discharges 3. The difference from the structure represented in FIG. 1 consists in that the nose-like projections 4 (not drawn) of the cathodes are situated in each case (within the context of the figure) at the same height, with the result that the overall pattern of the partial discharges is aligned in a different way. The relatively large intermediate regions thereby produced between the partial discharges 3 are provided with lozenge-shaped cutouts 5. The statements made in relation to FIG. 1 hold with regard to further improvements.

Figure 3:
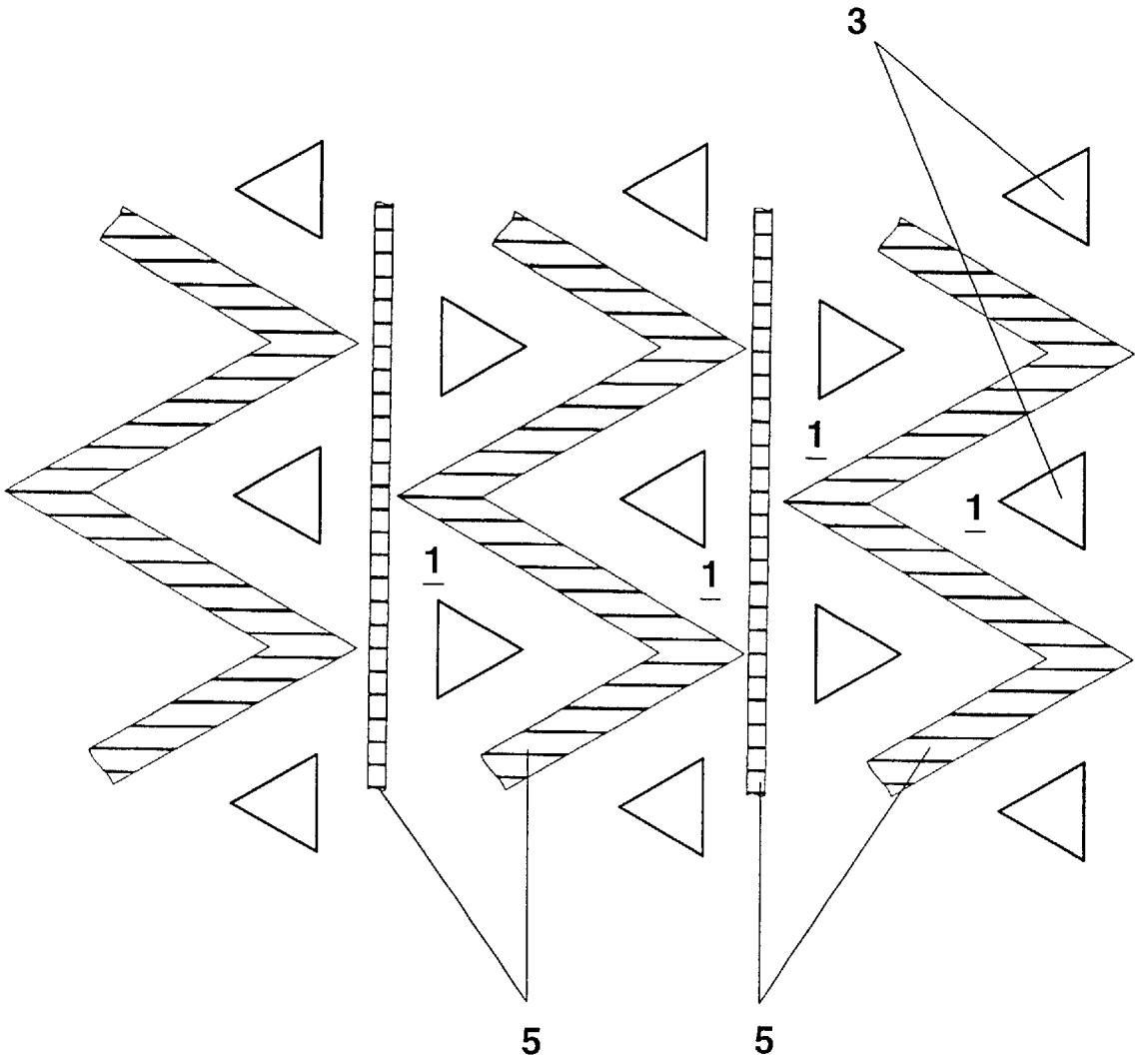
FIG. 3 shows a schematic view of an adapted fluorescent layer having a pattern of linear and saw-toothed line cutouts in relation to the partial discharges.

FIG. 3 relates, in turn, to the electrode structure 2 represented in FIG. 1, which is not repeated here, for the reasons mentioned. What is selected here, however, is a pattern of cutouts 5 in the fluorescent layer 1 which is different and covers the interspaces between the partial discharges 3 in a somewhat differentiated fashion. In particular, the strips left free which were mentioned in FIG. 1 are in this case filled up by linear cutouts, while the cutout triangles to be seen in FIG. 1 are lengthened here and combined to a certain extent to form a saw-toothed line. This structure has a further improvement in the luminance homogeneity by comparison with FIG. 1, but continues to exhibit abrupt transitions between the cutouts 5 and the otherwise continuous fluorescent layer 1.

Figure 4:
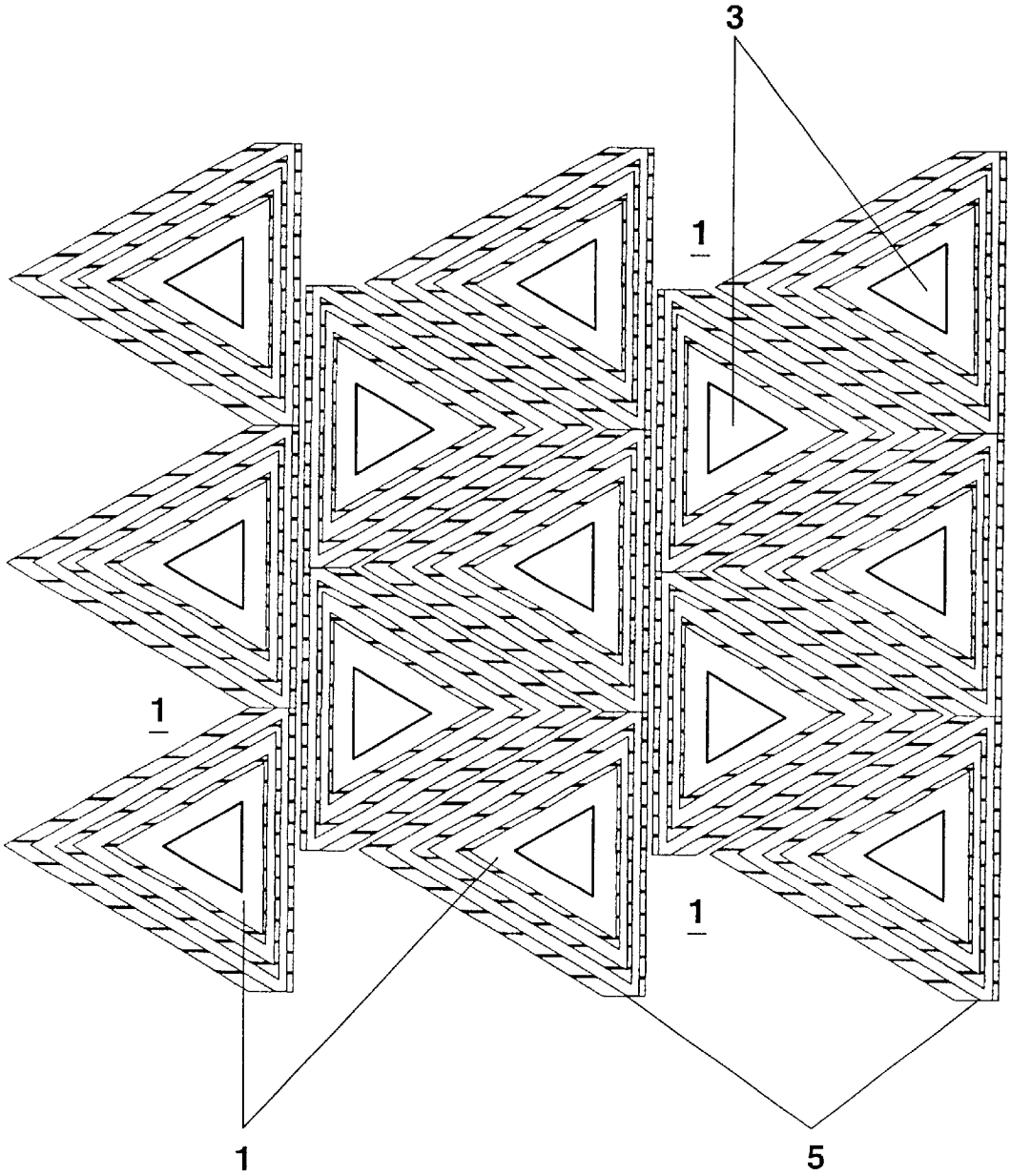
FIG. 4 shows a schematic view of an adapted fluorescent layer having a pattern of narrower linear and saw-toothed line cutouts wherein the mutual ratio of the width of the cutouts to width of the fluorescent layer between the cutouts increases with increasing distance from the partial discharges.

By contrast, the structure represented in FIG. 4 is further differentiated. It corresponds in basic geometry to FIG. 3, but the linear and saw-toothed cutouts are resolved to form a pattern of fine cutout strips running in parallel locally. Upon precise observation, it is seen that the mutual ratio of the width of the cutout strips to the width of the fluorescent layer situated therebetween increases with increasing distance from the partial discharges 3 and reaches a maximum in the middle between partial discharges.

After averaging by a milk-glass disk or another diffuser, these fine structures are no longer to be seen, with the result that there is, as it were, an effective approximation to a continuous course of layer thickness. A very far-reaching homogenization is thus possible given suitable tuning to the inhomogeneities of the discharge structure.

Figure 5:
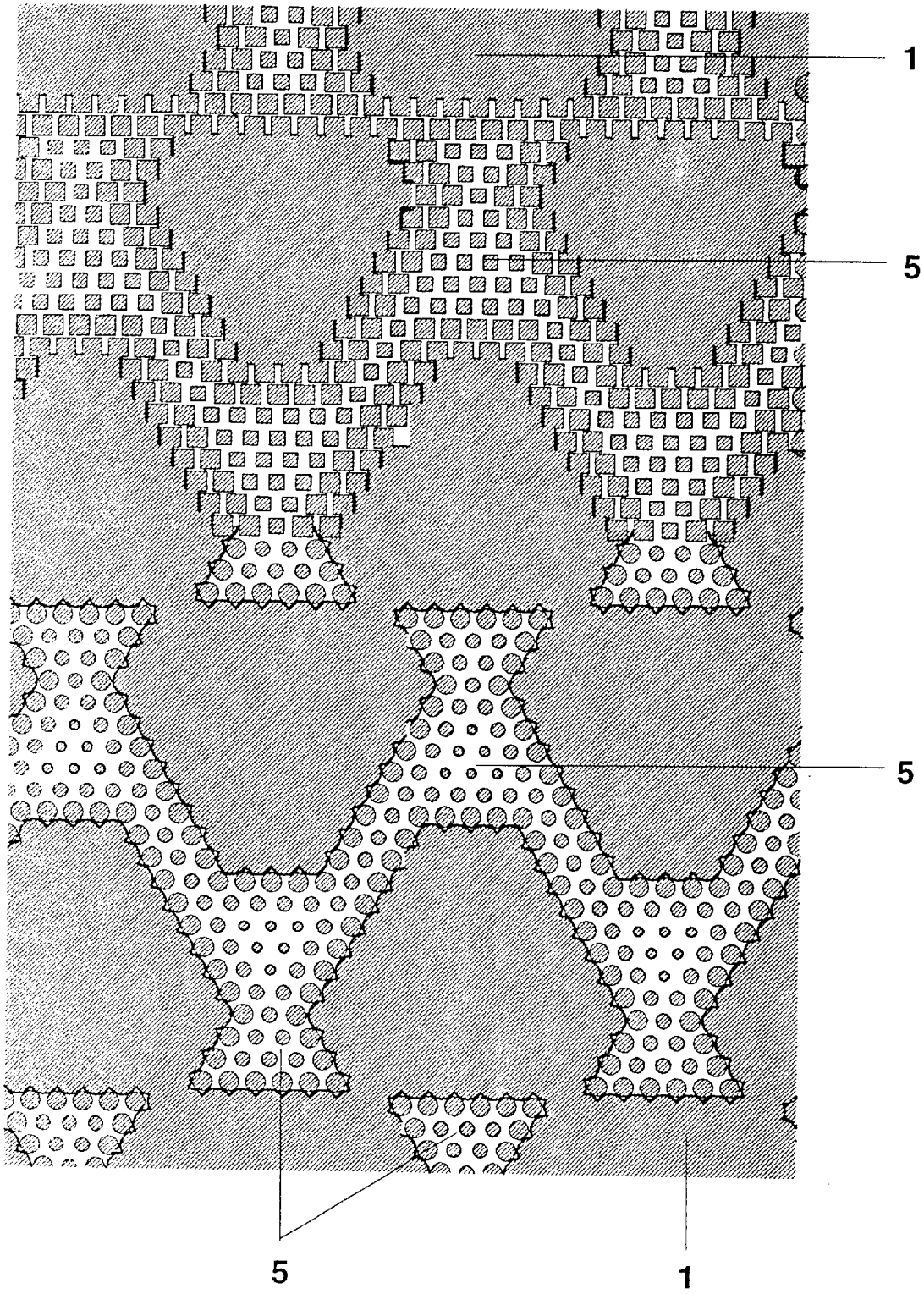
FIG. 5 shows a further schematic view of another adapted fluorescent layer in which the cutout regions contain fluorescent circles or squares.

The structure represented in FIG. 5 proceeds in the same direction, the strip pattern prevailing in FIG. 4 being replaced by an arrangement of fluorescent circles of varying diameter (on the left-hand side of the figure), surrounded by cutout surfaces 5. The partial discharge triangles 3 are no longer drawn in, but are situated in the continuous regions of the fluorescent layer 1.

The circles are replaced by squares of varying edge length on the right-hand side of the figure. Of course, any other geometric figures are .also conceivable; in particular, the cutouts 5 can also have a circular or square shape and be situated in a surrounding region of fluorescent material.

What is claimed is:

1. A fluorescent lamp comprising a discharge vessel filled with a gas filling, the discharge vessel having a fluorescent layer (1), and an electrode structure (2) for a dielectrically impeded discharge, the electrode structure fixing a geometric distribution of partial discharges (3) during operation of the lamp, the fluorescent layer (1) having a varying layer thickness wherein the layer thickness varies from a maximum thickness in a region containing the partial discharges to a minimum thickness in a region between the partial discharges.

2. The fluorescent lamp as claimed in claim 1, in which the electrode structure (2) fixes the geometric distribution by means of cathode projections (4).

3. The fluorescent lamp as claimed in claim 1, in which the electrode structure (2) fixes the geometric distribution by means of variations in the thickness of an electrode dielectric.

4. The fluorescent lamp as claimed in claim 1, in which the electrode structure (2) fixes the geometric distribution by means of variations in the width of electrodes.

5. The fluorescent lamp as claimed in claim 1, in which the layer thickness variation is stepped.

6. The fluorescent lamp as claimed in claim 1, in which the layer thickness variation, at least in a local averaging, has the thinnest regions in the middle between the partial discharges, and the thickest regions directly above the partial discharges (3).

7. The fluorescent lamp as claimed in claim 1, in which the layer thickness variation is formed at least partially by a pattern of cutouts (5) in the fluorescent layer (1).

8. The fluorescent lamp as claimed in claim 7, in which, apart from the cutouts (5), the fluorescent layer (1) has an essentially uniform layer thickness.

9. The fluorescent lamp as claimed in claim 7, in which the pattern of cutouts (5) in the fluorescent layer (1) which is fine relative to the spacing between neighboring partial discharges (3) approaches a quasi-continuous course between, in a local averaging, thin and thick regions by virtue of varying proportions of cutouts and layer surfaces.

10. The fluorescent lamp as claimed in claim 7, in which the discharge vessel is comprised of two parallel plates having a frame therebetween and the cutouts (5) in at least one respective direction are narrower than the spacing between the two plates.

11. The fluorescent lamp as claimed in claim 1, in which a reduction in layer thickness to an average value of between 30% and 95% of the layer thickness over the partial discharges (3) is present in intermediate discharge regions with a luminance reduced by more than 20% with respect to the luminance maxima.

12. The fluorescent lamp as claimed in claim 1, in which the discharge vessel is formed essentially from two plates arranged parallel to one another, and in which the electrode structure is arranged on the inner wall of the first plate, and the fluorescent layer is arranged on the inner wall of the second plate.

13. The method as claimed in claim 12 with screen printing of the fluorescent partial layers using different screens.

14. The fluorescent lamp as claimed in claim 13, in which the variation in the layer thickness is stepped.

15. The fluorescent lamp as claimed in claim 13, in which the variation in layer thickness is formed at least partially by a pattern of cutouts in the fluorescent layer.

16. The fluorescent lamp as claimed in claim 15, in which a quasi-continuous course between regions of average thin and average thick layer thicknesses is formed by varying the proportions of the cutouts and remaining fluorescent layer in a local averaging.

17. A method for producing a fluorescent lamp as claimed in claim 1, in which the fluorescent layer (1) is applied using a printing method in a plurality of partial layers, the partial layers having deviating geometric structures.

18. A fluorescent lamp comprising a discharge vessel filled with a gas filling, the discharge vessel having a fluorescent layer (1), and an electrode structure (2) for a dielectrically impeded discharge, the electrode structure fixing a geometric distribution of partial discharges (3) during operation of the lamp, the fluorescent layer (1) having a varying layer thickness wherein the layer thickness varies from a maximum layer thickness immediately over the discharges to a reduced thickness in an intermediate discharge region.

19. The fluorescent lamp as claimed in claim 18, in which the reduced thickness is between 30% to 95% of the maximum layer thickness.

20. The fluorescent lamp as claimed in claim 18, in which the reduced thickness is between 50% to 90% of the maximum layer thickness.

* * * * *